US006325692B1

(12) United States Patent
Webb

(10) Patent No.: US 6,325,692 B1
(45) Date of Patent: Dec. 4, 2001

(54) TOY AND STORAGE PLAY SET

(76) Inventor: John Webb, 1611 Holmes Ave., Prospect Park, PA (US) 19076

( * ) Notice: Subject to any disclaimer, the term of this patent is extended or adjusted under 35 U.S.C. 154(b) by 0 days.

(21) Appl. No.: 09/502,293

(22) Filed: Feb. 11, 2000

(51) Int. Cl.[7] ..... A63H 33/04; A63H 33/20
(52) U.S. Cl. ..... 446/75; 446/92; 446/490
(58) Field of Search ..... 446/75, 76, 77, 446/71, 72, 73, 333, 334, 335, 336, 487, 490, 491, 92, 177

(56) References Cited

U.S. PATENT DOCUMENTS

| | | | | |
|---|---|---|---|---|
| D. 325,479 | | 4/1992 | Barfield . | |
| 1,907,285 | * | 5/1933 | Block | 446/335 |
| 2,499,147 | * | 2/1950 | Land | 446/334 |
| 2,716,840 | * | 9/1955 | Armstrong | 446/334 |
| 2,832,174 | * | 4/1958 | Yip | 446/75 X |
| 3,235,259 | | 2/1966 | Glass et al. . | |
| 3,790,165 | | 2/1974 | Schmidt et al. . | |
| 4,091,563 | | 5/1978 | Noble et al. . | |
| 4,299,050 | * | 11/1981 | Chan | 446/75 X |
| 4,472,008 | | 9/1984 | Pearlstein . | |
| 5,417,603 | * | 5/1995 | De Chazal | 446/75 |
| 5,570,879 | | 11/1996 | Glancey et al. . | |
| 5,732,953 | * | 3/1998 | Tamura | 446/334 X |

* cited by examiner

*Primary Examiner*—D. Neal Muir

(57) ABSTRACT

A toy and storage play set for providing a wrestling ring and storage area. The toy and storage play set includes a container device and wrestling ring device. The container device has a housing having a top side which is open. A covering member covers the housing. The wrestling ring device has a stage portion. The stage portion is generally planar, having a facing side and a back side. The back side is releasably securable to the covering member. Four elongate members each have a first end and a second end. Each of the elongate members has central portion having two spaced bores therein such that a top bore and a bottom bore is defined. A first cord forms a closed hoop and extends through each of the top bores. A second cord also forms a closed hoop and extends through each of the bottom bores. A plurality of fastening means fasten the elongate members to the facing side of the stage portion. Each of the fastening means is coupled to one of the second ends of the elongate members. Each of the fastening means is a suction cup.

10 Claims, 3 Drawing Sheets

TOY AND STORAGE PLAY SET

BACKGROUND OF THE INVENTION

1. Field of the Invention

The present invention relates to toys and more particularly pertains to a new toy and storage play set for providing a wrestling ring and storage area.

2. Description of the Prior Art

The use of toys is known in the prior art. More specifically, toys heretofore devised and utilized are known to consist basically of familiar, expected and obvious structural configurations notwithstanding the myriad of designs encompassed by the crowded prior art which have been developed for the fulfillment of countless objectives and requirements.

Known prior art includes U.S. Pat. No. 3,790,165; U.S. Pat. No. 4,091,563; U.S. Pat. No. 3,235,259; U.S. Pat. No. 4,472,008; U.S. Pat. No. 5,570,879; and U.S. Pat. No. 325,479.

While these devices fulfill their respective, particular objectives and requirements, the aforementioned patents do not disclose a new toy and storage play set. The inventive device includes a container device and wrestling ring device. The container device has a housing having a top side which is open. A covering member covers the housing. The wrestling ring device has a stage portion. The stage portion is generally planar, having a facing side and a back side. The back side is releasably securable to the covering member. Four elongate members each have a first end and a second end. Each of the elongate members has central portion having two spaced bores therein such that a top bore and a bottom bore is defined. A first cord forms a closed hoop and extends through each of the top bores. A second cord also forms a closed hoop and extends through each of the bottom bores. A plurality of fastening means fasten the elongate members to the facing side of the stage portion. Each of the fasten in L means is coupled to one of the second ends of the elongate members. Each of the fastening means is a suction cup.

In these respects, the toy and storage play set according to the present invention substantially departs from the conventional concepts and designs of the prior art, and in so doing provides an apparatus primarily developed for the purpose of providing a wrestling ring and storage area.

SUMMARY OF THE INVENTION

In view of the foregoing disadvantages inherent in the known types of toys now present in the prior art, the present invention provides a new toy and storage play set construction wherein the same can be utilized for providing a wrestling ring and storage area.

The general purpose of the present invention, which will be described subsequently in greater detail is to provide a new toy and storage play set apparatus and method which has many of the advantages of the toys mentioned heretofore and many novel features that result in a new toy and storage play set which is not anticipated, rendered obvious, suggested, or even implied by any of the prior art toys, either alone or in any combination thereof.

To attain this. the present invention generally comprises a container device and wrestling ring device. The container device has a housing having a top side which is open. A covering member covers the housing. The wrestling ring device has a stage portion. The stage portion is generally planar, having a facing side and a back side. The back side is releasably securable to the covering member. Four elongate members each have a first end and a second end. Each of the elongate members has central portion having two spaced bores therein such that a top bore and a bottom bore is defined. A first cord forms a closed hoop and extends through each of the top bores. A second cord also forms a closed hoop and extends through each of the bottom bores. A plurality of fastening means fasten the elongate members to the facing side of the stage portion. Each of the fastening means is coupled to one of the second ends of the elongate members. Each of the fastening means is a suction cup.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of he invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy and storage play set apparatus and method which has many of the advantages of the toys mentioned heretofore and many novel features that result in a new toy and storage play set which is not anticipated, rendered obvious, suggested, or even implied by any of the prior art toys, either alone or in any combination thereof.

It is another object of the present invention to provide a new toy and storage play set which may be easily and efficiently manufactured and marketed.

It is a further object of the present invention to provide a new toy and storage play set which is of a durable and reliable construction.

An even further object of the present invention is to provide a new toy and storage play set which is susceptible of a low cost of manufacture with regard to both materials and labor, and which accordingly, is then susceptible of low prices of sale to the consuming public, thereby making such toy and storage play set economically available to the buying public.

Still yet another object of the present invention is to provide a new toy and storage play set which provides in the apparatuses and methods of the prior art some of the advantages thereof, while simultaneously overcoming some of the disadvantages normally associated therewith.

Still another object oaf the present invention is to provide a new toy and storage play set for providing a wrestling ring and storage area.

Yet another object of the present invention is to provide a new toy and storage play set which includes a container device and wrestling ring device. The container device has a housing having a top side which is open. A covering member covers the housing. wrestling ring device has a stage portion. The stage portion is generally planar having a facing side and a back side. The back side is releasably securable to the covering member. Four elongate members each have a first end and a second end. Each of the elongate members has central portion having two spaced bores therein such that a top bore and a bottom bore is defined. A first cord forms a closed hoop and extends through each of the top bores. A second cord also forms a closed hoop and extends through each of the bottom bores. A plurality of fastening means fasten the elongate members to the facing side of the stage portion. Each of the fastening means is coupled to one of the second ends of the elongate members. Each of the fastening means is a suction cup.

Still yet another object of the present invention is to provide a new toy and storage play set that combines a storage area and a wrestling ring for use with professional wrestling toys.

Even still another object of the present invention is to provide a new toy and storage play set that has elastomeric turnbuckles for safety of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
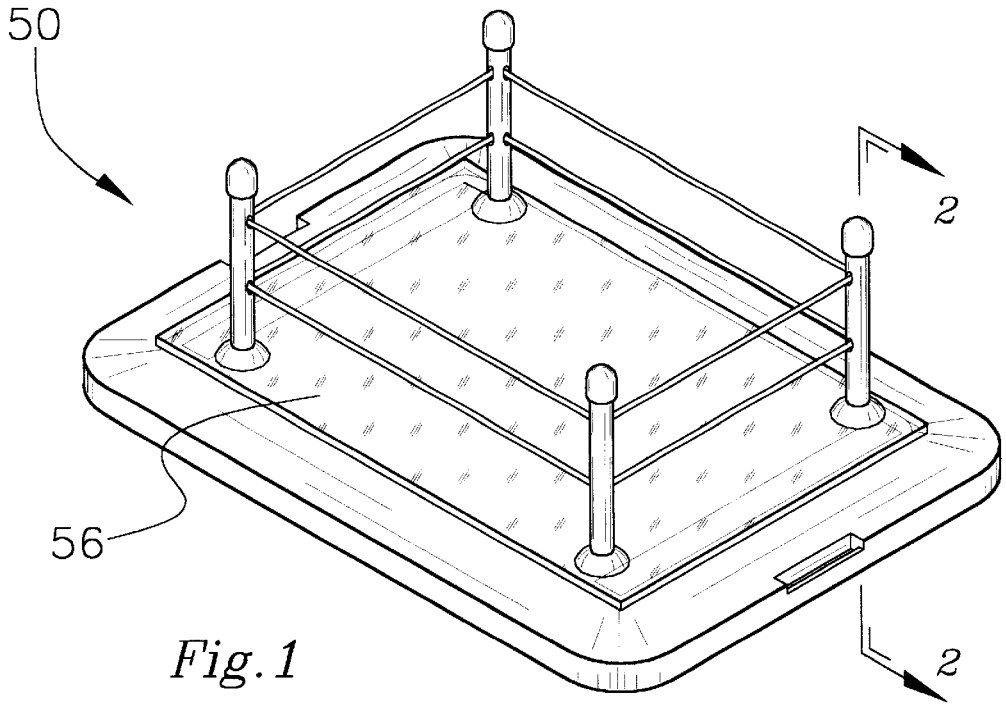
FIG. 1 is a schematic perspective view of the wrestling ring device of a new toy and storage play set according to the present invention.
Figure 2:
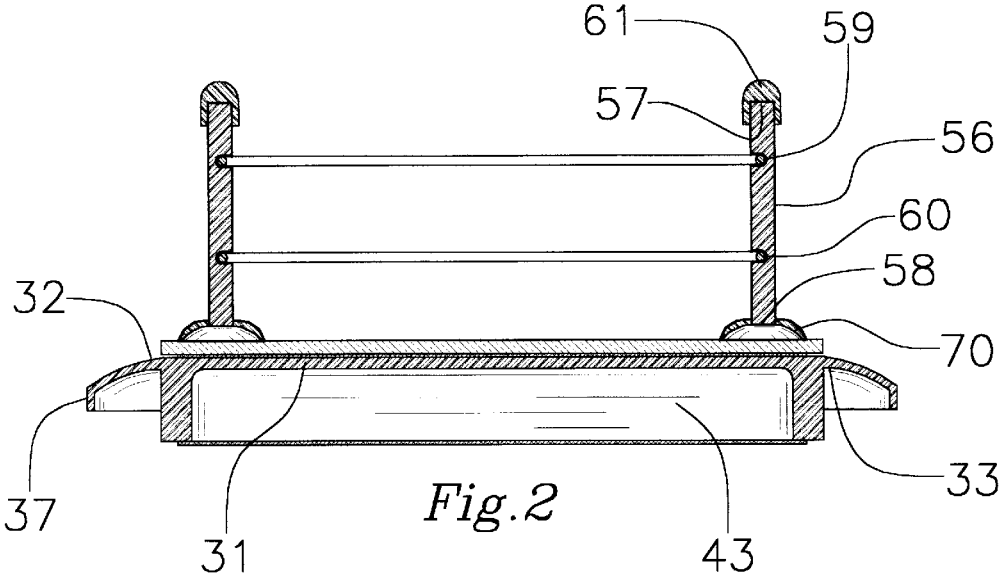
FIG. 2 is a schematic side view taken along line 2—2 of the present invention.
Figure 3:
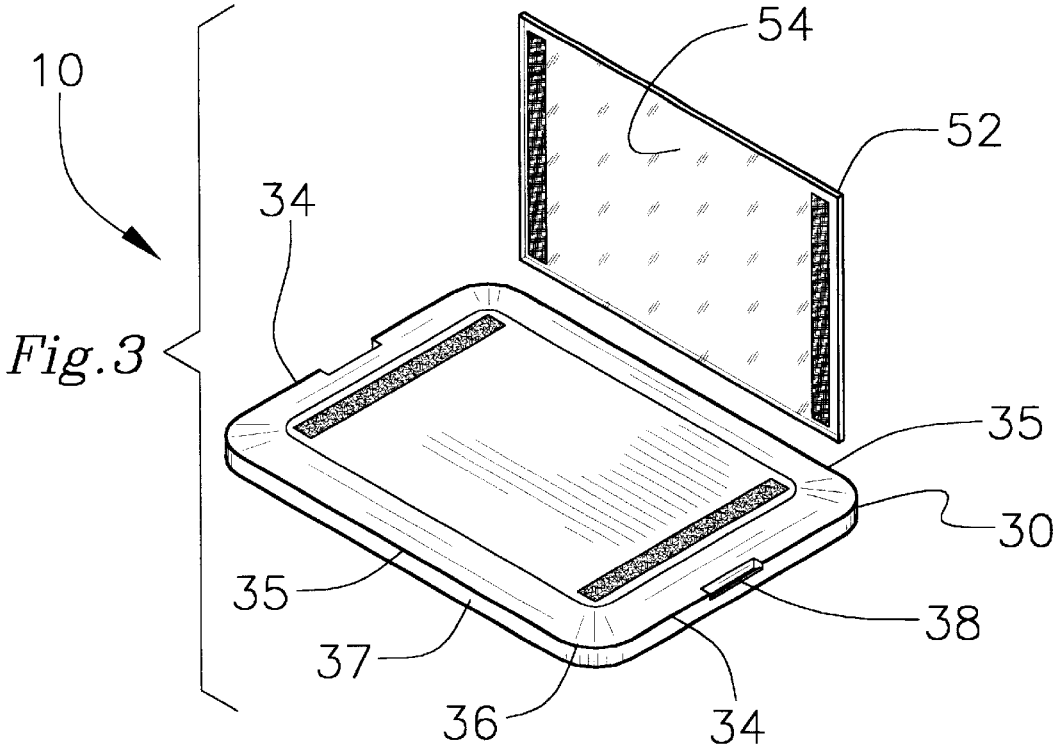
FIG. 3 is a schematic perspective view of the covering member of the present invention.
Figure 4:
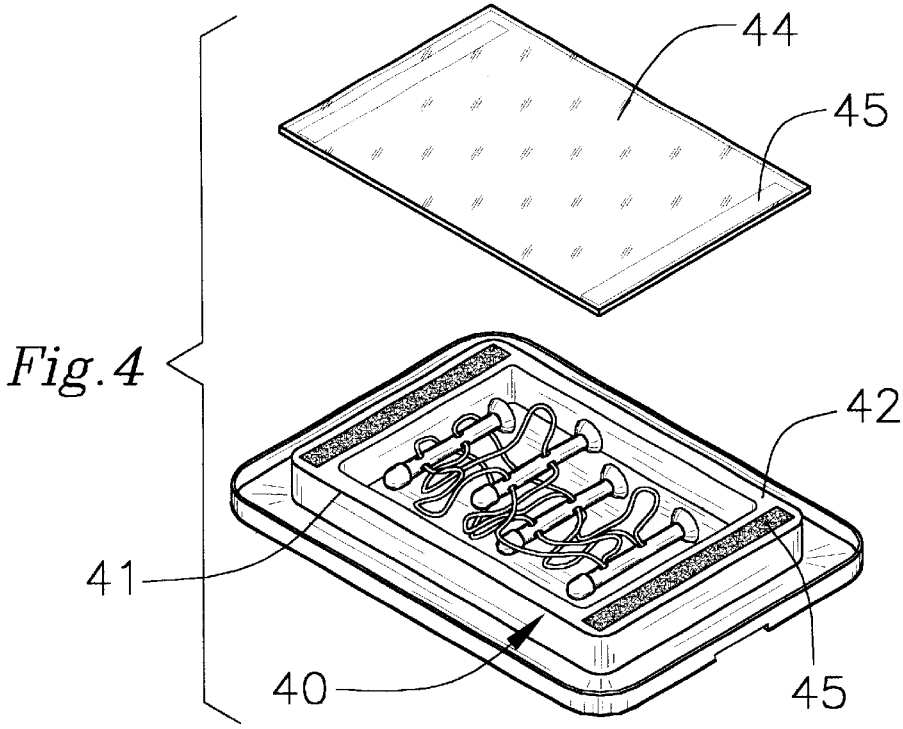
FIG. 4 is a schematic perspective view of the storage chamber of the present invention.
Figure 5:
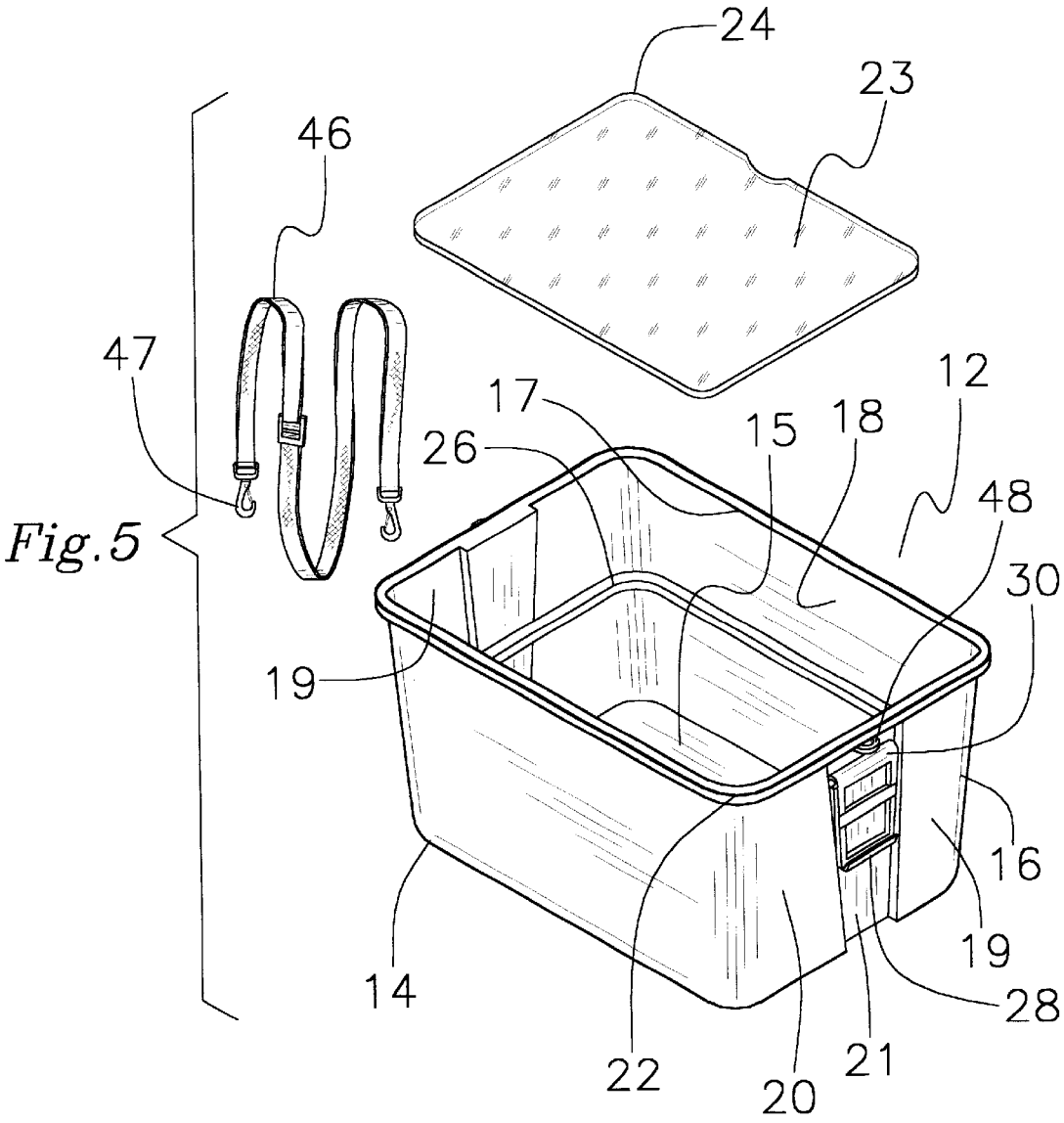
FIG. 5 is a schematic perspective view of the container of the present invention.

With reference now to the drawings and in particular to FIGS. 1 through 5 thereof, a new toy and storage play set embodying the principles and concepts of the present invention and generally designated by the reference numeral 10 will be described.

As best illustrated in FIGS. 1 through 5, the toy and storage play set 10 generally comprises a container device 12 and a wrestling ring device 50.

The container device 12 generally comprises a housing 14. The housing has a bottom wall 15 and a peripheral wall 16 fixedly coupled to the bottom wall. The peripheral wall 16 has a free edge 17 and an interna surface 18. The peripheral wall 16 comprises two pairs of opposing side walls. A first pair of opposing side walls 19 has an external surface 20. Each of the external surfaces 20 has an elongate depression 21 therein. The free edge 17 of the peripheral wall 16 has a shoulder 22 integrally coupled thereto and extending away from a central portion of the housing 12.

A shelf 23 for placing in the housing 12 is generally planar and has a peripheral edge 24. Ideally, the shelf 23 is generally transparent and comprises a plastic.

A shoulder 26 supports the shelf 23. The shoulder 26 is fixedly coupled to and extends away from a perimeter of the internal surface 18 of the peripheral wall 16. The shoulder 26 is located generally between the free edge 17 and the bottom wall 15.

A pair of handles 28 carries the housing 12. Each of the handles 28 is hingedly mounted to one of the external surfaces 20 of the first pair of opposing side walls 19. Each of the handles 28 is located in one of the elongate depressions 21. A hinged portion 30 of each of the handles 28 is generally adjacent to the free edge 17 of the peripheral wall 16.

A covering member 30 covers the housing 12. The covering member 30 has base wall 31 having a top surface 32, a bottom surface 33 a first pair of opposing edges 34 and a second pair of opposing edges 35. The base wall 31 has a peripheral edge 36 having a wall 37 extending therefrom. The wall 37 is adapted to be removably coupled to the shoulder 22 on the peripheral wall 16 of the housing 12.

Each of a pair of grooves 38 in the base wall 31 of the covering member 30 receives a portion of one of the handles 28. Each of the grooves 38 is generally located adjacent to one of the edges 36 of the first pair 34 of edges. The handles 28 are adapted to be removably secured in the grooves 38.

A storage chamber 40 comprises a block 41 fixedly coupled to and extending away from the bottom surface 33 of the base wall 31 of the covering member 30. The block 41 has a top surface 42 directed away from the base wall 31. The block 41 preferably has a height generally less than four inches.

A slot 43 in the block 41 is in a middle portion of the top surface 42 of the block 41 and extends to the base wall 31. The slot 43 defines a storage compartment.

A cover 44 for the slot 43 is generally planar and has a size substantially equal to the top surface of the block 40. The cover 44 is generally transparent and ideally comprises a plastic.

A securing means 45 releasably secures the cover 44 to the block 40. The securing means 45 is on the cover and the top surface of the block. The securing means 45 is located such that the securing means on the cover is aligned with the securing means on the top surface. The securing means 45 is ideally a hook and loop securing means.

A strap 46 for carrying the housing 12 has a first end and a second end. Each of the first and second ends has a hook 47 thereon.

A pair of ring members 48 receives the hooks 47 from the strap 46. Each of the ring members 48 is fixedly coupled to the shoulder 22 of the peripheral wall 16. Each of the ring members 48 is positioned generally adjacent to one of the handles 28.

A wrestling ring device 50 includes a stage portion 52. The stage portion 52 is generally planar, having a facing side 53 and a back side 54. The back side 54 is releasably securable to the top surface 32 of the base wall 31 of the covering member 30 with a hook and loop securing means. The stage portion 52 has a generally rectangular shape, and ideally is comprised of a plastic.

Four elongate members 56 each have a first end 57 and a second end 58. Each of the elongate members 56 has a central portion having two spaced bores therein such that a top bore 59 and a bottom bore 60 is defined. Each of the bores are generally orientated perpendicular to a longitudinal axis of the elongate members 56. Each of the elongate members 56 comprises an elastomeric material. Each of the elongate members defines a turnbuckle. Each of the first ends 57 has a rounded cap 61 fixedly coupled thereto.

A first cord 63 forms a closed hoop. The first cord extends through each of the top bores 59 of the elongate members 56. The first cord comprises an elastomeric material.

A second cord 65 also forms a closed hoop. The second cord extends through each of the bottom bores 60 of the elongate members 56. The second cord 65 comprises an elastomeric material.

A plurality of fastening means 70 fasten the elongate members 56 to the facing side 56 of the stage portion 52. Each of the fastening means 70 is coupled to one of the second ends 58 of the elongate members 56. Preferably, each of the fastening means 70 is a suction cup.

In use, the housing 12 holds wrestling toys. The storage chamber 40 holds the wrestling ring device 50 when it is not in use. The stage portion 52 is attached to the cover member 30 and the elongate members 56 are releasably coupled to the stage portion.

As to a further discussion of the manner of usage and operation of the present invention the same should be apparent from the above description. Accordingly, no further discussion relatings to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy and storage play set for professional wrestling toys, said set comprising:

a container device, said container device comprising:

a housing having a top side being open;

a covering member for covering said housing;

a wrestling ring device, said wrestling ring device comprising:

a stage portion, said stage portion being generally planar having a facing side and a back side, said back side being releasably securable to said covering member;

four elongate members, each of said elongate members having a first end and a second end, each of said elongate members having central portion having two spaced bores therein such that a top bore and a bottom bore is defined;

a first cord, said first cord being a closed hoop, said first cord extending through each of said top bores of said elongate members;

a second cord, said second cord being a closed hoop, said second cord extending through each of said bottom bores of said elongate members; and a plurality of fastening means for fastening said elongate members to said facing side of said stage portion, each of said fastening means being coupled to one of said second ends of said elongate members, each of said fastening means being a suction cup.

2. The toy and storage play set as in claim 1, wherein said said housing having a bottom wall and a peripheral wall fixedly coupled to said bottom wall, said peripheral wall having a free edge and an internal surface, said peripheral wall comprising two pairs of opposing, side walls, said free edge of said peripheral wall having a shoulder integrally coupled thereto and extending away from a central portion of said housing; and said covering member having base wall having a top surface, a bottom surface, a first pair of opposing edges and a second pair of opposing edges, said base wall having a peripheral edge having a wall extending therefrom, said wall being adapted to removably couple to said shoulder on said peripheral wall of said housing.

3. The toy and storage play set as in claim 2, said container device further comprising:

a shelf for placing in said housing, said shelf being generally planar, said shelf having a peripheral edge; and a shoulder for supporting said shelf, said shoulder being fixedly coupled to and extending away from a perimeter of said internal surface of said peripheral wall, said shoulder being located generally between said free edge and said bottom wall of said housing.

4. The toy and storage play set as in claim 2, said container device further comprising:

a first pair of opposing sides walls of said housing having an external surface, each of said external surfaces of said first pair of opposing side walls having an elongate depression therein;

a pair of handles for carrying said housing, each of said handles being hingedly mounted to one of said external surfaces of said first pair of opposing, side walls, each of said handles being located in one of said elongate depressions, a hinged portion of each of said handles being generally adjacent to said free edge of said peripheral wall.

5. The toy and storage play set as in claim 4, said container device further comprising:

a pair of grooves in said base wall of said covering member each receive a portion of one of the handles, each of said grooves being generally located adjacent to one of the edges of said first pair of edges, said handles being adapted to be removably secured in said grooves.

6. The toy and storage play set as in claim 2, said container device further comprising:

a storage chamber, said storage chamber comprising:

a block, said block being fixedly coupled to and extending, away from said bottom surface of said base wall of said covering member, said block having a top surface directed away from said base wall;

a slot in said block, said slot being in a middle portion of said top surface of said block and extending to said base wall, said slot defining a storage compartment;

a cover for said slot, said cover being generally planar and having a size substantially equal to said top surface of said block; and a securing means for releasably securing said cover to said block.

7. The toy and storage play set as in claim 4, said container device further comprising:

a strap for carrying said housing, said strap having a first end and a second end, each of said first and second ends having a hook thereon; and a pair of ring members for receiving said hooks from said strap, each of said ring member being fixedly coupled to said shoulder of said peripheral wall, each of said ring members being positioned generally adjacent to one of said handles.

8. The toy and storage play set as in claim 2, wherein said wrestling ring, device comprises:

said back side being releasably securable to said top surface of said base wall of said covering member, said stage portion having a generally rectangular shape, said stage portion comprising a plastic.

9. The toy and storage play set as in claim 1, wherein said wrestling ring device further comprises:

each of said elongate members comprising an elastomeric material, each of said elongate members defining a turnbuckle, each of said first ends having a rounded cap fixedly coupled thereto.

10. A toy and storage play set for professional wrestling toys, said set comprising:

a container device, said container device comprising:

a housing, said housing having a bottom wall and a peripheral wall fixedly coupled to said bottom wall, said peripheral wall having a free edge and an internal surface, said peripheral wall comprising two pairs of opposing side walls, a first pair of opposing sides walls having an external surface, each of said external surfaces having an elongate depression therein, said free edge of said peripheral wall having a shoulder integrally coupled thereto and extending away from a central portion of said housing;

a shelf for placing in said housing, said shelf being generally planar, said shelf having a peripheral edge, said shelf being generally transparent, said shelf comprising a plastic;

a shoulder for supporting said shelf, said shoulder being fixedly coupled to and extending away from a perimeter of said internal surface of said peripheral wall, said shoulder being located generally between said free edge and said bottom wall;

a pair of handles for carrying said housing, each of said handles being hingedly mounted to one of said external surfaces of said first pair of opposing side walls, each of said handles being located in one of said elongate depressions, a hinged portion of each of said handles being generally adjacent to said free edge of said peripheral wall;

a covering member for covering said housing, said covering member having base wall having a top surface a bottom surfaces a first pair of opposing edges and a second pair of opposing edges, said base wall having a peripheral edge having a wall extending therefrom, said wall being adapted to removably couple to said shoulder on said peripheral wall of said housing;

a pair of grooves in said base wall of said covering member each receive a portion of one of the handles, each of said grooves being generally located adjacent to one of the edges of said first pair of edges, said handles being adapted to be removably secured in said grooves;

a storage chamber, said storage chamber comprising:

a block, said block being fixedly coupled to and extending away from said bottom surface of said base wall of said covering member, said block having a top surface directed away from said base wall, said block having a height generally less than four inches;

a slot in said block, said slot being in a middle portion of said top surface of said block and extending to said base wall, said slot defining a storage compartment;

a cover for said slot, said cover being generally planar and having a size substantially equal to said top surface of said block, said cover being generally transparent and comprising a plastic;

a securing means for releasably securing said cover to said block, said securing means being on said cover and said top surface of said block, said securing means being located such that said securing means on said cover is aligned with said securing means on said top surface, said securing, means being a hook and loop securing means;

a strap for carrying said housing, said strap having a first end and a second end, each of said first and second ends having a hook thereon;

a pair of ring members for receiving said hooks from said strap, each of said ring member being fixedly coupled to said shoulder of said peripheral wall, each of said ring members being positioned generally adjacent to one of said handles;

a wrestling ring device, said wrestling ring device comprising:

a stage portion, said stage portion being generally planar having a facing side and a back side, said back side being, releasably securable to said top surface of said base wall of said covering member, said stage portion having a generally rectangular shape, said stage portion comprising a plastic;

four elongate members, each of said elongate members having a first end and a second end, each of said elongate members having central portion having two spaced bores therein such that a top bore and a bottom bore is defined, each of said bores being generally orientated perpendicular to a longitudinal axis of said elongate members, each of said elongate members comprising an elastomeric material, each of said elongate members defining a turnbuckle, each of said first ends having a rounded cap fixedly coupled thereto, a first cord, said first cord being a closed hoop, said first cord extending through each of said top bores of said elongate members said first cord comprising an elastomeric material;

a second cord, said second cord being a closed hoop, said second cord extending through each of said bottom bores of said elongate members, said second cord comprising an elastomeric material; and a plurality of fastening means for fastening said elongate members to said facing side of said stage portion, each of said fastening means being coupled to one of said second ends of said elongate members, each of said fastening means being a suction cup.

* * * * *